US005884662A

United States Patent [19]

Ko

[11] Patent Number: 5,884,662

[45] Date of Patent: Mar. 23, 1999

[54] PROTECTIVE GUIDE SLEEVE STRUCTURE OF A PULLING TYPE FAUCET

[75] Inventor: Hsi-Chia Ko, Changhua Hsien, Taiwan

[73] Assignee: Chung Cheng Faucet Co., Ltd., Changhua Hsien, Taiwan

[21] Appl. No.: 122,996

[22] Filed: Jul. 28, 1998

[51] Int. Cl.[6] ..... E03C 1/042

[52] U.S. Cl. ..... 137/801; 4/678; 239/588

[58] Field of Search ..... 4/678; 137/801; 239/588

[56] References Cited

U.S. PATENT DOCUMENTS 5,090,062 2/1992 Hochstrasser ..... 137/801 X 5,349,987 9/1994 Shieh ..... 137/801

*Primary Examiner*—Gerald A. Michalsky

*Attorney, Agent, or Firm*—Bacon & Thomas, PLLC

[57] ABSTRACT

A protective guide sleeve structure of a pulling type faucet including a protective guide sleeve. An upper end of the guide sleeve is disposed with a trumpet-shaped opening. A long restricting plate and two short restricting plates upward extend from a rear lateral edge of the opening. When assembled, the guide sleeve is fitted into an adapter from a cut section thereof with the trumpet-shaped opening abutting against a lower edge of the cut section. An extensible guide tube of a sprinkling head is passed through the cut section of the adapter and the protective guide sleeve. When the extensible guide tube is Pulled outward or retracted inward, the trumpet-shaped opening of the guide sleeve guides the extensible guide tube to smoothly move outward or inward and the protective guide sleeve protects the extensible guide tube from abrasion.

2 Claims, 3 Drawing Sheets

PROTECTIVE GUIDE SLEEVE STRUCTURE OF A PULLING TYPE FAUCET

BACKGROUND OF THE INVENTION

The present invention relates to a protective guide sleeve structure of a pulling type faucet in which a protective guide sleeve in fitted in an adapter of the faucet and an extensible guide tube of a sprinkling head is passed through the protective guide sleeve. When the extensible guide tube is pulled outward or retracted inward, the trumpet-shaped opening of the guide sleeve guides the extensible guide tube to smoothly move outward or inward. Also, the protective guide sleeve protects the extensible guide tube from directly abrading a lower edge of a cut section of the adapter.

The pulling type faucet has been widely used in a kitchen or a toilet for providing more convenient washing operation. However, the extensible guide tube of the sprinkling head of the faucet is directly attached to a lower edge of a cut section of the adapter. Therefore, when the extensible guide tube is pulled outward or retracted inward, a considerably great frictional force is exerted onto the extensible guide tube. This shortens using life of the extensible guide tube and makes it difficult and laborious to pull and extend the extensible guide tube.

SUMMARY OF THE INVENTION

It is therefore a primary object of the present invention to provide a protective guide sleeve structure of a pulling type faucet in which a protective guide sleeve in fitted in an adapter of a seat body of the faucet and an extensible guide tube of a sprinkling head is passed through the protective guide sleeve. When the extensible guide tube is pulled outward or retracted inward, the protective guide sleeve protects the extensible guide tube from directly abrading a lower edge of a cut section of the adapter. Also, the protective guide sleeve guides the extensible guide tube to smoothly move outward or inward so as to prolong the using life of the extensible guide tube and facilitate pulling of the extensible guide tube.

The present invention can be best understood through the following description and accompanying drawings, wherein:

DETAILED DESCRIPTION OF THE PREFERRED EMBODIMENT

Figure 1:
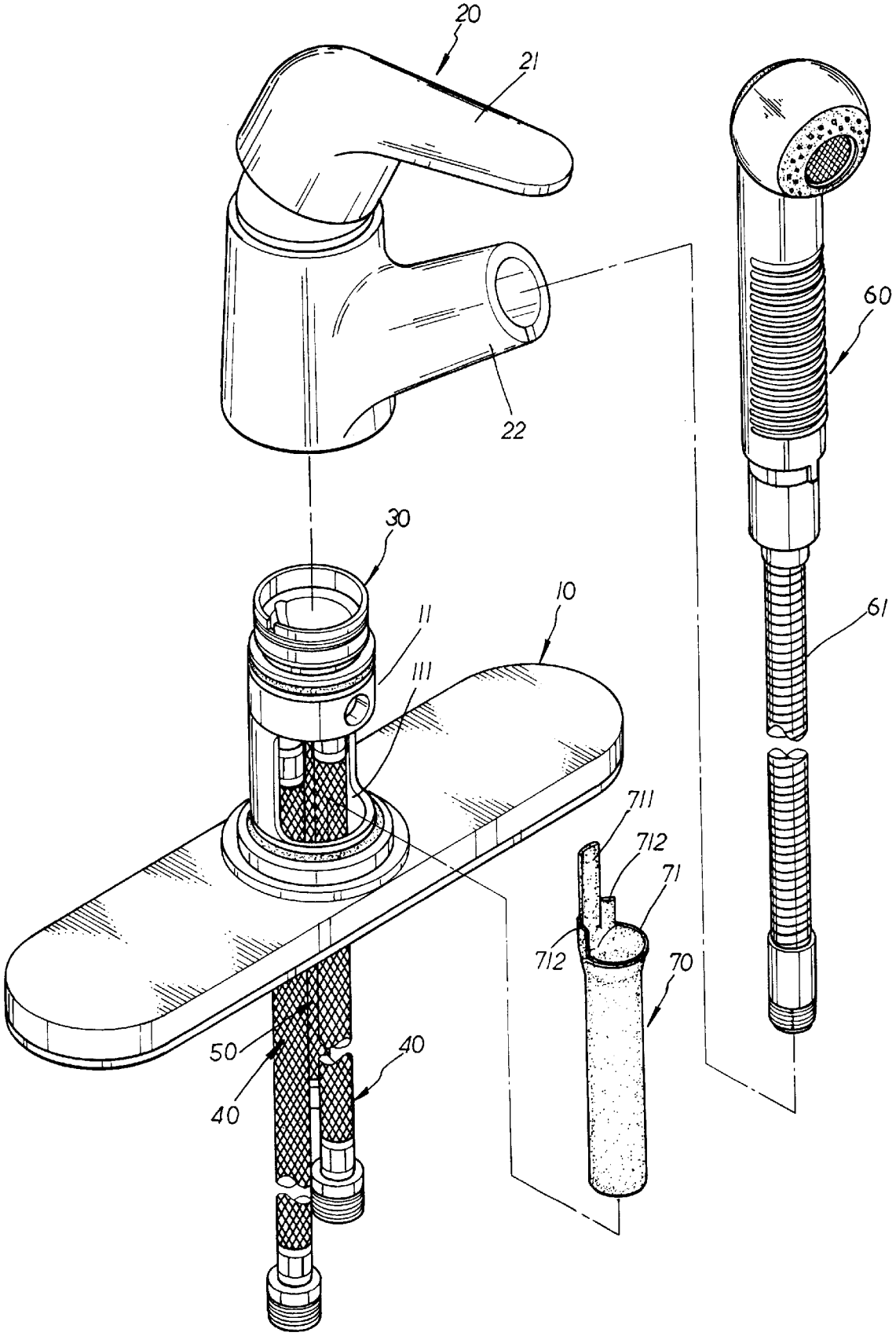
FIG. 1 is a perspective exploded view of the pulling type faucet of the present invention.

Please refer to FIG. 1. The faucet of the present invention includes a seat body 10, a faucet casing 20, a valve seat 30, a cold and a hot water incoming tubes 40, a water outgoing tube 50, a sprinkling head 60 and a protective guide sleeve 70. A middle section of top face of the seat body 10 is disposed with an adapter 11 having a lateral cut section 111. An upper end of the faucet casing 20 is disposed with a controlling handle 21. A cylindrical insertion section 22 extends from a lateral side of the casing 20. The valve seat 30 is fitted with the adapter 11 of the seat body 10. A bottom face of the valve seat 30 is formed with two incoming thread holes and an outgoing thread hole for respectively connecting with the cold and hot water incoming tubes 40 and the water outgoing tube 50. The end of the sprinkling head 60 is screwed with an extensible guide tube 61. An upper end of the guide sleeve 70 is disposed with a trumpet-shaped opening 71. A long restricting plate 711 and two short restricting plates 712 upward extend from a rear lateral edge of the opening 71.

Figure 2:
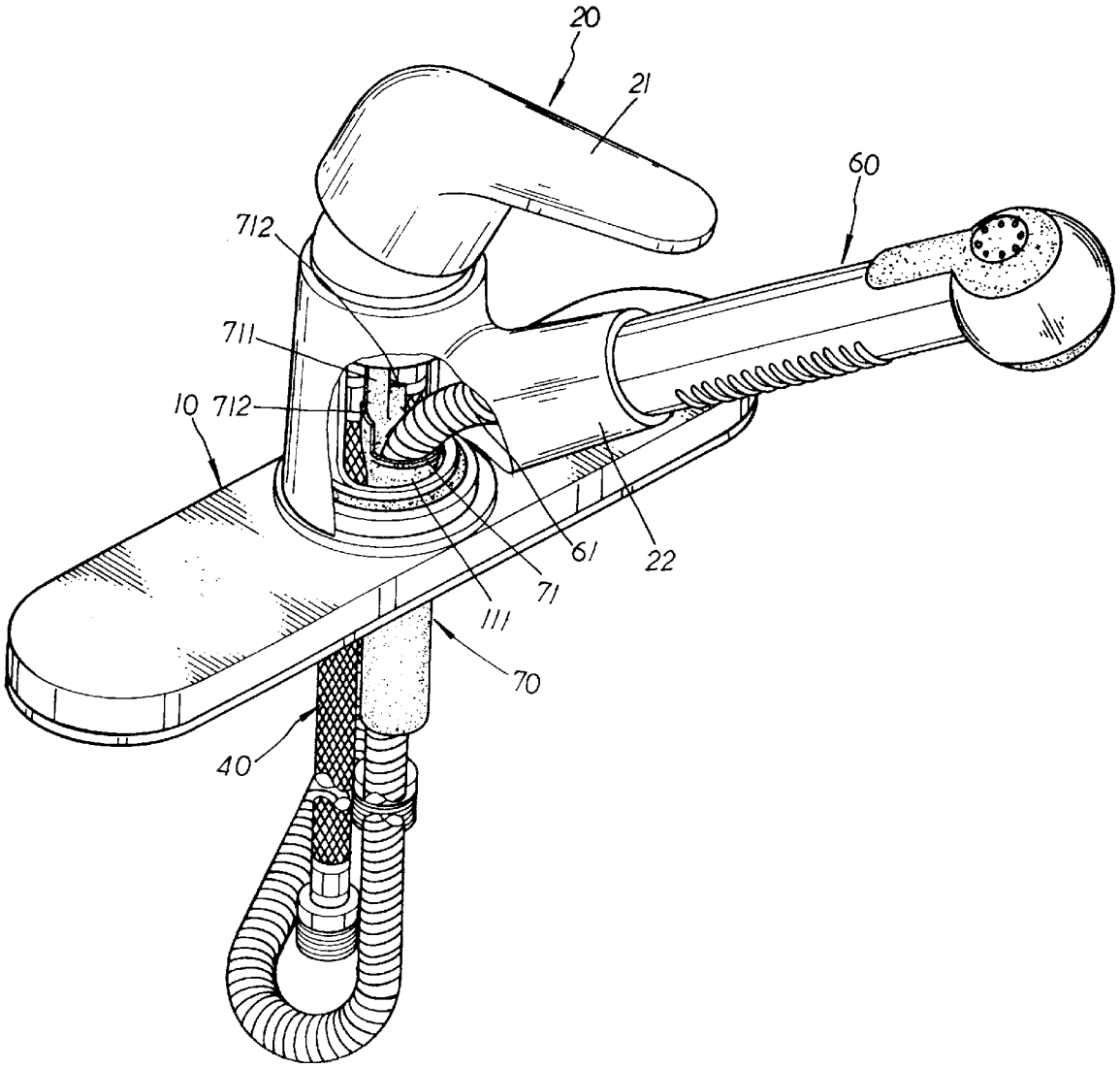
FIG. 2 is a perspective assembled view of the pulling type faucet of the present invention.

Referring to FIG. 2, when assembled, the guide sleeve 70 is fitted into the adapter 11 from the cut section 111 thereof with the trumpet-shaped opening 71 abutting against a lower edge of the cut section 111. At this time, the long restricting plate 711 is attached between the cold and hot water incoming tubes 40 and the two short restricting plates 712 is attached to outer peripheries of the incoming tubes 40. The top end of the long restricting plate 711 abuts against the bottom face of the valve seat 30 to restrict the displacement of the guide sleeve 70. The faucet casing 20 is fitted around the adapter 11 with the insertion section 22 of the faucet casing 20 aligned with the cut section 111 of the adapter 11. The sprinkling head 60 is inserted with the insertion section 22 of the faucet casing 20 with the end of the extensible guide tube 61 passed through the cut section 111 of the adapter 11 and the protective guide sleeve 70 to connect with the lower end of the water outgoing tube 70.

Figure 3:
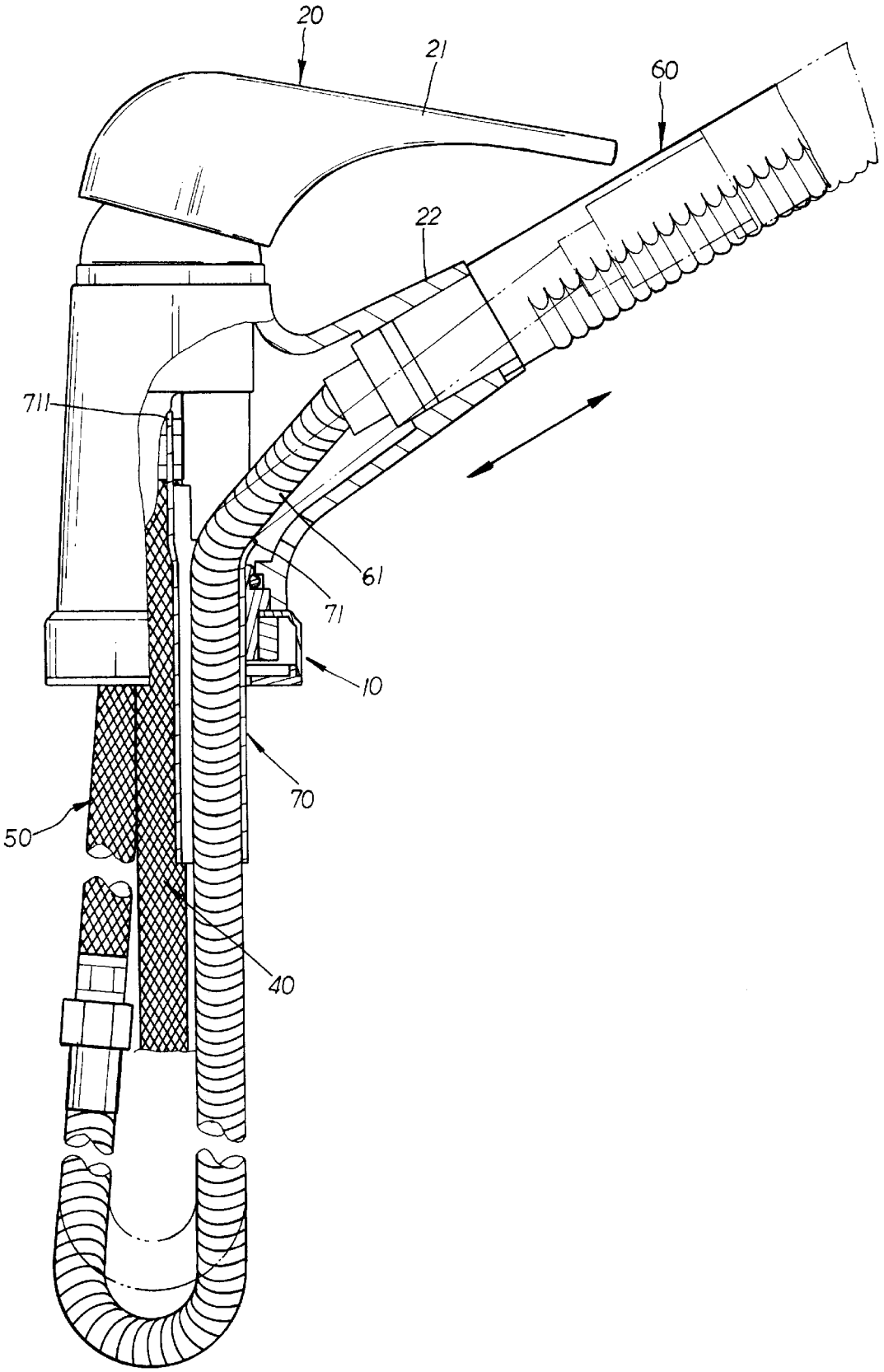
FIG. 3 shows the pulling and retraction of the extensible guide tube of the sprinkling head of the present invention.

FIG. 3 shows the action of the extensible guide tube of the sprinkling head. In use, the guide tube 61 of the sprinkling head 60 is pulled outward or retracted inward. At this time, the trumpet-shaped opening 71 of the guide sleeve 70 guides the extensible guide tube 61 to smoothly move outward or inward. Therefore, the guide tube 61 is prevented from abrading the lower edge of the cut section 111 of the adapter 11 so that the using life of the extensible guide tube 61 is prolonged and the pulling of the extensible guide tube 61 is facilitated.

The above description and accompanying drawings are only used to illustrate one embodiment of the present invention. Any modification or variation derived from the embodiment should fall within the scope of the present invention.

What is claimed is:

1. A protective guide sleeve structure of a pulling type faucet comprising a seat body, a faucet casing, a valve seat, a cold and a hot water incoming tubes, a water outgoing tube, a sprinkling head and a protective guide sleeve, a middle section of top face of the seat body being disposed with an adapter having a lateral cut section, an upper end of the faucet casing being disposed with a controlling handle, an insertion section extending from a lateral side of the casing, the valve seat being fitted with the adapter of the seat body, a bottom face of the valve seat being formed with two incoming thread holes and an outgoing thread hole for respectively connecting with the cold and hot water incoming tubes and the water outgoing tube, an end of the sprinkling head being screwed with an extensible guide tube, said structure being characterized in that an upper end of the guide sleeve is disposed with a trumpet-shaped opening, a long restricting plate and two short restricting plates upward extending from a rear lateral edge of the opening, whereby when assembled, the guide sleeve is fitted into the adapter from the cut section thereof with the trumpet-shaped opening abutting against a lower edge of the cut section, the long restricting plate being attached between the cold and hot water incoming tubes and the two short restricting plates being attached to outer peripheries of the two incoming tubes, the sprinkling head being inserted with the insertion section of the faucet casing with an end of the extensible guide tube passed through the cut section of the adapter and the protective guide sleeve to connect with a lower end of the water outgoing tube, whereby when the extensible guide tube is pulled outward or retracted inward, the trumpet-shaped opening of the guide sleeve guides the extensible guide tube to smoothly move outward or inward and the protective guide sleeve protects the extensible guide tube from abrasion.

2. A protective guide sleeve structure as claimed in claim 1, wherein when the extensible guide tube is Pulled outward, a top end of the long restricting plate of the protective guide sleeve abuts against a bottom face of the valve seat to restrict displacement of the protective guide sleeve.

* * * * *